US007661807B2

(12) United States Patent
Nakano et al.

(10) Patent No.: US 7,661,807 B2
(45) Date of Patent: Feb. 16, 2010

(54) ULTRAVIOLET RAYS EMITTER

(75) Inventors: Keitaro Nakano, Nagano (JP); Takashi Oyanagi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 399 days.

(21) Appl. No.: 11/185,965

(22) Filed: Jul. 21, 2005

(65) Prior Publication Data

US 2006/0050122 A1 Mar. 9, 2006

(30) Foreign Application Priority Data

Jul. 21, 2004 (JP) ..... P2004-213409
Jul. 21, 2004 (JP) ..... P2004-213410

(51) Int. Cl.
*B41J 2/01* (2006.01)

(52) U.S. Cl. ..... 347/102; 347/212; 347/232; 347/233; 347/238; 427/493

(58) Field of Classification Search ..... None
See application file for complete search history.

(56) References Cited

U.S. PATENT DOCUMENTS

| | | | | |
|---|---|---|---|---|
| 5,623,001 | A | 4/1997 | Figov | |
| 6,561,640 | B1 * | 5/2003 | Young | 347/102 |
| 7,131,723 | B2 * | 11/2006 | Hoshino | 347/102 |
| 7,211,299 | B2 * | 5/2007 | Siegel | 427/493 |
| 7,232,212 | B2 * | 6/2007 | Iwase | 347/102 |
| 7,249,835 | B2 * | 7/2007 | Hoshino et al. | 347/102 |
| 2003/0142194 | A1 * | 7/2003 | Inoue et al. | 347/233 |
| 2003/0142195 | A1 * | 7/2003 | Katsuma et al. | 347/238 |
| 2003/0222961 | A1 | 12/2003 | Nakajima | |
| 2004/0085423 | A1 * | 5/2004 | Bronstein et al. | 347/102 |
| 2004/0114016 | A1 * | 6/2004 | Yokoyama | 347/102 |
| 2004/0114017 | A1 * | 6/2004 | Yokoyama | 347/102 |
| 2004/0135874 | A1 * | 7/2004 | Oehlbeck et al. | 347/232 |
| 2005/0007439 | A1 * | 1/2005 | Hirasawa et al. | 347/212 |

FOREIGN PATENT DOCUMENTS

| | | |
|---|---|---|
| JP | 3-216379 A | 9/1991 |
| JP | 5-186725 A | 7/1993 |
| JP | 5-054667 B | 8/1993 |
| JP | 6-200204 A | 7/1994 |
| JP | 7-224241 A | 8/1995 |
| JP | 8-048922 A | 2/1996 |

(Continued)

*Primary Examiner*—Matthew Luu
*Assistant Examiner*—John P Zimmermann
(74) *Attorney, Agent, or Firm*—Sughrue Mion, PLLC

(57) ABSTRACT

An ultraviolet rays emitter for irradiating ultraviolet rays on an ink of an ultraviolet curing type adhered onto a recording medium includes semiconductor light emitting elements for emitting ultraviolet rays and a support member for mutually supporting these semiconductor light emitting elements in a matrix with optical axes thereof in almost parallel, and the row or column of the semiconductor light emitting elements has a structure in which two kinds of semiconductor light emitting elements having different wavelength ranges or more are arranged in order. Alternatively, an ultraviolet rays emitter has a structure in which a plurality of semiconductor light emitting elements is mutually supported with a support member in a positional relationship in which the optical axes of the respective elements are mutually inclined in such a manner that the irradiation regions of ultraviolet rays emitted from the semiconductor light emitting elements overlap on a recording medium.

9 Claims, 7 Drawing Sheets

FOREIGN PATENT DOCUMENTS

| | | | |
|---|---|---|---|
| JP | 8-218016 | A | 8/1996 |
| JP | 10-007956 | A | 1/1998 |
| JP | 10-250052 | A | 9/1998 |
| JP | 10-324836 | A | 12/1998 |
| JP | 2000-044857 | A | 2/2000 |
| JP | 2000-119574 | A | 4/2000 |
| JP | 2000-504778 | T | 4/2000 |
| JP | 2000-158793 | A | 6/2000 |
| JP | 2000-186242 | A | 7/2000 |
| JP | 2000-186243 | A | 7/2000 |
| JP | 2000-336295 | A | 12/2000 |
| JP | 2001-220526 | A | 8/2001 |
| JP | 2001-512777 | T | 8/2001 |
| JP | 2002-080767 | A | 3/2002 |
| JP | 2003-191593 | A | 7/2003 |
| JP | 2003-191594 | A | 7/2003 |
| JP | 2003-313476 | A | 11/2003 |
| JP | 2003-326691 | A | 11/2003 |
| JP | 2004-1326 | A | 1/2004 |
| JP | 2004-027154 | A | 1/2004 |

* cited by examiner

ULTRAVIOLET RAYS EMITTER

CROSS-REFERENCE TO RELATED APPLICATION

This application claims the benefit of Japanese Patent Application Nos. 2004-213409 and 2004-213410 filed on Jul. 21, 2004 in the Japanese Patent Office, the disclosures of which are incorporated herein by reference in their entirety.

BACKGROUND OF THE INVENTION

The present invention relates to an ultraviolet rays emitter for emitting ultraviolet rays on an ink of an ultraviolet curing type which is adhered onto a recording medium, and more particularly to an improvement for implementing a quick curing treatment for the ink of the ultraviolet curing type which is adhered onto the recording medium without giving a thermal damage to the recording medium.

The ink of the ultraviolet curing type is different from ordinary water-based and oil-based inks in that quick curing is carried out and stable printing quality can be maintained without the influence of the physical properties of a recording medium (for example, a print paper) such as an ink permeability if the ink of the violet curing type is adhered onto the recording medium and an ultraviolet ray is then irradiated in a proper amount.

In an ink jet printer using the ink of the ultraviolet curing type, it is necessary to provide an ultraviolet rays emitter for irradiating an ultraviolet ray on an ink adhered onto a recording medium around a recording head for ejecting the ink of the ultraviolet curing type as an ink droplet to be a particle and adhering the same ink onto the recording medium.

There have been proposed various associated ultraviolet rays emitters in which an ultraviolet lamp such as a mercury lamp or a metal halide lamp is served as a light source for emitting ultraviolet rays (for example, see Patent Document 1).

However, a light emitted from the ultraviolet lamp has a continuous spectrum within a wide wavelength region and includes a visible light and an infrared light in addition to a plurality of ultraviolet lights having different wavelength regions. Therefore, there is a problem in that the infrared light in the continuous spectrum gives a thermal damage to the recording medium.

There is a problem in that the structure of a device is complicated and a cost is increased if a band-pass filter is provided in order to remove a hazardous infrared light.

The ultraviolet lamp greatly consumes power. Therefore, there is a problem in that the energy saving of the ultraviolet rays emitter is hard to perform.

In addition, the ultraviolet lamp itself is large. For this reason, there is also a problem in that it is hard to reduce the size and weight of a device model.

For this reason, recently, there has been studied an ultraviolet rays emitter in which a semiconductor light emitting element such as an ultraviolet rays emitting diode (an ultraviolet LED) including no infrared light and capable of emitting only an ultraviolet light in a specific wavelength region and reducing consumed power is employed as a light source, thereby preventing a thermal damage from being given to a recording medium due to content of the infrared light, while saving energy and reducing a size and a weight (for example, see Patent Document 2).

[Patent Document 1] JP-A-2004-1326

[Patent Document 2] JP-A-2003-326691

As compared with the ultraviolet lamp, however, the semiconductor light emitting element has lower irradiation intensity of ultraviolet rays to be emitted. For this reason, an irradiation is to be carried out for a long time before the ink of the ultraviolet curing type, which is adhered onto the recording medium is completely cured. For example, there is a problem in that a print processing speed in an ink jet printer is hindered from being enhanced.

Moreover, a color ink of the ultraviolet curing type contains a coloring material for each color (a pigment or a dye). For example, a white ink of the ultraviolet curing type contains titanium dioxide as a white coloring material. The titanium dioxide has a physical property for absorbing ultraviolet rays having a wavelength of 200 to 375 nm.

If the wavelength region of ultraviolet rays emitted from the semiconductor light emitting element is overlapped with an absorption wavelength region of the coloring material such as titanium dioxide or the like contained in the ink, therefore, the ultraviolet rays irradiated from the semiconductor light emitting element is consumed by an absorption through the coloring material such as titanium dioxide or the like. Consequently, the effect of curing the ink is reduced to half, and furthermore, an irradiation for a long time is required.

Accordingly, it is desirable that a semiconductor light emitting element having a different wavelength region from the absorption wavelength of an ultraviolet absorbing substance such as the coloring material, for example, titanium dioxide should be served as a light source. In case of the semiconductor light emitting element, however, a wavelength range which can be irradiated is restricted to a small range. For this reason, actually, it is hard to maintain sufficient ultraviolet irradiation intensity in a wavelength region in which the absorption wavelengths of various ultraviolet absorbing substances are avoided.

In general, moreover, an ultraviolet ray in a low wavelength region has high energy and can cure, in a short time, the surface of ink that is irradiated. On the other hand, transmission force into the inner port of an ink film is low. For this reason, the ultraviolet curing in the inner part of the ink film tends to be delayed. To the contrary, ultraviolet rays in a high wavelength region have high transmission force into the inner part of the ink film. Therefore, the same ultraviolet rays are effective for the ultraviolet curing in the inner part of the ink film. However, there is a problem in that energy is low, resulting in an increase in a time required for curing the ink.

More specifically, in the case in which a semiconductor light emitting element having a low peak wavelength is used as a light source for emitting ultraviolet rays, the curing can be efficiently carried out in a short time if the adhering thickness of the ink of the ultraviolet curing type is small, and the ultraviolet curing in the inner part is delayed if the adhering thickness is great. For this reason, there is a problem in that stable curing cannot be obtained. To the contrary, in the case in which a semiconductor light emitting element having a high peak wavelength is used, the ultraviolet rays reach the inner part and the curing can be carried out stably even if the adhering thickness of the ink of the ultraviolet curing type is great. However, a long time is required for the curing. As a result, there is a problem in that the curing treatment is delayed.

SUMMARY OF THE INVENTION

Therefore, the invention has an object to solve the problems and to provide an ultraviolet rays emitter using a semiconductor light emitting element capable of preventing a thermal damage from being given to a recording medium as a light source for emitting ultraviolet rays, in which an ink of an ultraviolet curing type which is adhered onto the recording medium can be cured quickly irrespective of a adhering thickness thereof and the ultraviolet absorbing function of an ultraviolet absorbing substance in the ink.

In order to achieve the object, according to the invention, there is provided:

(1) An ultraviolet rays emitter, emitting ultraviolet rays onto an ink of an ultraviolet curing type, which is ejected onto a recording medium by recording head, comprising:

a support member; and a plurality of light emitting elements attached to the support member and adapted to emit ultraviolet rays, wherein the light emitting elements are arranged in rows and columns with optical axes thereof aligned in almost parallel to one another so that irradiation regions of the ultraviolet rays emitted by the light emitting elements are gathered in a state being almost adjacent to one another so as to form a large irradiation region, and at least two of the emitting elements emitting the ultraviolet rays having different wavelength ranges are arranged in one of the rows and the columns.

(2) The ultraviolet rays emitter according to (1), wherein the light emitting element includes an ultraviolet rays emitting diode.

(3) The ultraviolet rays emitter according to (1), wherein the light emitting element includes a laser diode.

(4) The ultraviolet rays emitter according to (1), wherein the support member is disposed at the vicinity of the recording head.

(5) An ultraviolet rays emitter, emitting ultraviolet rays onto an ink of an ultraviolet curing type, which is ejected onto a recording medium by recording head, comprising:

a support member; and a plurality of light emitting elements attached to the support member and adapted to emit ultraviolet rays, wherein the light emitting elements are disposed in a manner which optical axes of the light emitting elements are inclined so that irradiation regions of the ultraviolet rays emitted by the light emitting elements are overlapped with one another at the recording medium.

(6) The ultraviolet rays emitter according to (5), wherein the irradiation regions of the ultraviolet rays having different wavelength ranges are overlapped with one another.

(7) The ultraviolet rays emitter according to (5), wherein the irradiation regions of the ultraviolet rays having a same wavelength range are overlapped with one another.

(8) The ultraviolet rays emitter according to (5), wherein the support member includes an attaching surface to which the light emitting elements attached, the attaching surface has a curved shape extending along a transport direction in which the recording medium is transported, and a center of curvature of the curved shape substantially corresponds to the overlapped irradiation regions.

(9) The ultraviolet rays emitter according to (5), wherein the light emitting element includes an ultraviolet rays emitting diode.

(10) The ultraviolet rays emitter according to (5), wherein the light emitting element includes a laser diode.

(11) The ultraviolet rays emitter according to (5), wherein the support member is disposed at the vicinity of the recording head.

(12) A recording device for recording on a recording medium comprising:

a recording head movable relative to the recording medium in a main scanning direction;

a feeder adapted to feed the recording medium in a sub scanning direction; and an ultraviolet rays emitter having an ultraviolet rays emitting element array, the array having a plurality of ultraviolet rays emitting elements in a row extending in the sub scanning direction.

(13) The recording device according to (12), wherein the emitting elements in the row are adapted to emit ultraviolet rays in parallel to one another.

(14) The recording device according to (12), wherein the emitting elements in the row are adapted to emit ultraviolet rays at least in part overlapping with one another at the recording medium.

(15) The recording device according to (12), wherein the array further has a plurality of ultraviolet rays emitting elements in a column extending in the main scanning direction, and the emitting elements in the column are adapted to emit ultraviolet rays in parallel to one another.

(16) The recording device according to (12), wherein the array further has a plurality of ultraviolet rays emitting elements in a column extending in the main scanning direction, and the emitting elements in the row are adapted to emit ultraviolet rays at least in part overlapping with one another at the recording medium.

(17) The recording device according to (12), wherein at least two of the emitting elements in the row emit ultraviolet rays having different wavelength ranges.

(18) The recording device according to (12), wherein at least two of the emitting elements in the row are adjacent to one another.

(19) An ultraviolet rays emitter for emitting ultraviolet rays onto a recording medium comprising:

an ultraviolet rays emitting element array, the array having a plurality of ultraviolet rays emitting elements in a row extending in a sub scanning direction and a plurality of ultraviolet rays emitting elements in a column extending in a main scanning direction.

According to the invention, the semiconductor light emitting element having a small wavelength region for an emitted light and including no infrared light in the emitted light is used as a light source for emitting ultraviolet rays. Therefore, it is possible to prevent a recording medium from being thermally damaged in the irradiation of ultraviolet rays.

Moreover, the semiconductor light emitting element to be a light source consumes smaller power and has a smaller size and weight than a known ultraviolet lamp. Therefore, it is also possible to implement energy saving and to reduce the size and weight of the device.

In a plurality of semiconductor light emitting elements arranged in a matrix on the support member, the mutual irradiation regions of the respective semiconductor light emitting elements are gathered in an almost adjacent state, thereby forming a large irradiation region. When passing through these irradiation regions, the recording medium passes through the irradiation region of a single semiconductor light emitting element at plural times. As compared with the case in which the ultraviolet rays are irradiated only once by the single semiconductor light emitting element, the sum of an amount of irradiation of the ultraviolet rays (irradiation intensity) is plural times as large. Even if the ultraviolet energy for each semiconductor light emitting element is low, it is possible to give high ultraviolet energy to the surface on the recording medium to which the ink of the ultraviolet curing type is adhered and to quickly cure the ink of the ultraviolet curing type which is adhered onto the recording medium.

In the respective rows or columns of the semiconductor light emitting elements arranged in the matrix on the support member, there are arranged two kinds of semiconductor light emitting elements or more which have different wavelength ranges for ultraviolet rays to be emitted. In the whole ultraviolet rays emitter, the ultraviolet rays are emitted over a continuous spectrum having a plurality of light emission peaks with different wavelengths, and ultraviolet rays in a low wavelength region and ultraviolet rays in a high wavelength region are irradiated on the ink adhered onto the recording medium, respectively.

More specifically, there are respectively irradiated ultraviolet rays in a low wavelength region which has small transmission force and high energy, and can cure the surface of the adhered ink in a short time and ultraviolet rays in a high wavelength region which has great transmission force and is effective for curing the inner part of the adhered ink. Consequently, the ink adhered onto the recording medium can progress the ultraviolet curing well on an inside and outside irrespective of a adhering thickness so that stable curing can be obtained quickly.

By the selection of at least one of the two kinds of semiconductor light emitting elements having different wavelength ranges for the ultraviolet rays to be emitted or more which has a different wavelength range from the absorption wavelength of an ultraviolet absorbing substance in the ink of the ultraviolet curing type which is to be adhered onto the recording medium, moreover, a part of the ultraviolet rays which are irradiated can effectively contribute to cure the ink without the absorption of the ultraviolet absorbing substance and the ink adhered onto the recording medium can also be cured quickly irrespective of the ultraviolet absorbing function of the ultraviolet absorbing substance in the ink.

Accordingly, the ink of the ultraviolet curing type which is adhered onto the recording medium can be cured quickly irrespective of a adhering thickness thereof and the ultraviolet absorbing function of the ultraviolet absorbing substance in the ink.

According to the invention, the irradiation regions of the ultraviolet rays emitted from the semiconductor light emitting elements are overlapped with one another at the recording medium. Therefore, if the semiconductor light emitting elements having the irradiation regions being overlapped with one another are mutually set to have a common wavelength region for the ultraviolet rays to be emitted, for example, the amount of irradiation of the ultraviolet rays per unit area (the irradiation intensity) is plural times as large as that in the case in which the ultraviolet rays is to be irradiated by a single semiconductor light emitting element. Even if the ultraviolet energy for each semiconductor light emitting element is low, it is possible to apply high ultraviolet energy to the surface on the recording medium to which the ink of the ultraviolet curing type is adhered and to quickly cure the ink of the ultraviolet curing type which is adhered onto the recording medium.

If the semiconductor light emitting elements having the overlapping irradiation regions are mutually set to have different wavelength regions for the ultraviolet rays to be emitted, for example, it is possible to irradiate ultraviolet rays in a larger wavelength region having a plurality of light emission peaks as compared with the case in which the ultraviolet rays is irradiated by a single semiconductor light emitting element. Even if the ultraviolet rays in a part of the wavelength regions are absorbed by the ultraviolet absorbing function of the ultraviolet absorbing substance in the ink of the ultraviolet curing type which is adhered onto the recording medium, therefore, the ultraviolet rays in the other wavelength regions can contribute to the curing of the ink without the absorption of the ultraviolet absorbing substance and can quickly cure the ink adhered onto the recording medium irrespective of the ultraviolet absorbing function of the ultraviolet absorbing substance in the ink.

According to the invention, the attaching surface of the support member to which the semiconductor light emitting element is to be attached has a curving shape. If the mutual semiconductor light emitting elements are perpendicularly attached to the attaching surface on the same circumference, therefore, the optical axes of the semiconductor light emitting elements are turned toward the center of curvature of the curving shape so that it is possible to easily obtain a state in which the irradiation regions are overlapped with one another.

For the semiconductor light emitting element to be used in the invention, an ultraviolet rays emitting diode or a laser diode is useful.

According to the invention, moreover, it is possible to shorten a time required for curing the ink of the ultraviolet curing type which is adhered onto the recording medium by the recording head of an ink jet printer for the same ink, thereby enhancing a print processing speed.

DETAILED DESCRIPTION OF PREFERRED EMBODIMENTS

A suitable embodiment of an ultraviolet rays emitter according to the invention will be described below in detail with reference to the drawings.

Figure 1:
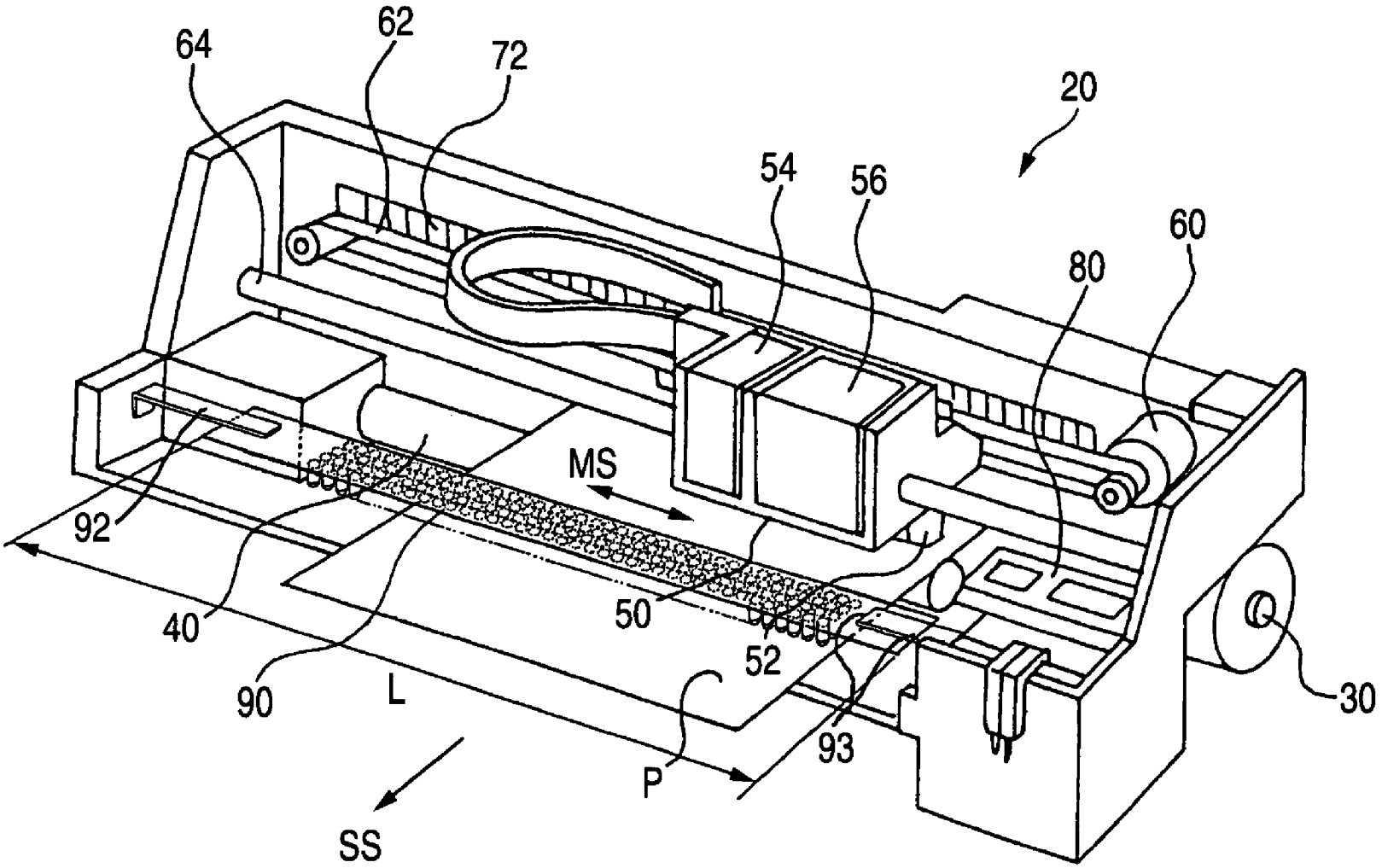
FIG. 1 is a schematic perspective view showing a main structure according to an embodiment of an ink jet printer mounting an ultraviolet rays emitter in accordance with a first example of the invention.

FIG. 1 is a schematic perspective view showing a main structure according to an embodiment of an ink jet printer 20 mounting an ultraviolet rays emitter in accordance with a first example of the invention. The first example will be described below.

The printer 20 comprises a paper feed motor 30 for feeding a print paper P to be a recording medium in a sub scanning direction SS, a platen 40, a print head 52 to be a recording head for causing an ink of an ultraviolet curing type to have a very small particle size and ejecting and adhering the same ink to the print paper P, a carriage 50 mounting the print head 52, a carriage motor 60 for moving the carriage 50 in a main scanning direction MS, and an ultraviolet rays emitter 90 for irradiating ultraviolet rays on an ink adhering surface of the print paper P to which the ink of the ultraviolet curing type is adhered by means of the print head 52.

The carriage 50 is towed by means of a tow belt 62 to be driven by the carriage motor 60 and is moved along a guide rail 64. The carriage 50 mounts a black cartridge 54 to be a black ink container accommodating a black ink to be supplied to the print head 52 and a color ink cartridge 56 to be a color ink container accommodating a color ink to be supplied to the print head 52 in addition to the print head 52.

An ink composition accommodated in each of the cartridges 54 and 56 is a so-called ink of an ultraviolet curing type.

A capping device 80 for closing the nozzle surface of the print head 52 at time of stop is provided in the home position of the carriage 50 (a position on a right side in FIG. 1). When a printing job is ended and the carriage 50 reaches the upper part of the capping device 80, the capping device 80 is automatically lifted by means of a mechanism which is not shown so that the nozzle surface of the print head 52 is closed. By the capping, the ink in a nozzle can be prevented from being dried. The positioning control of the carriage 50 is carried out in order to accurately place the carriage 50 in the position of the capping device 80, for example.

Figure 2:
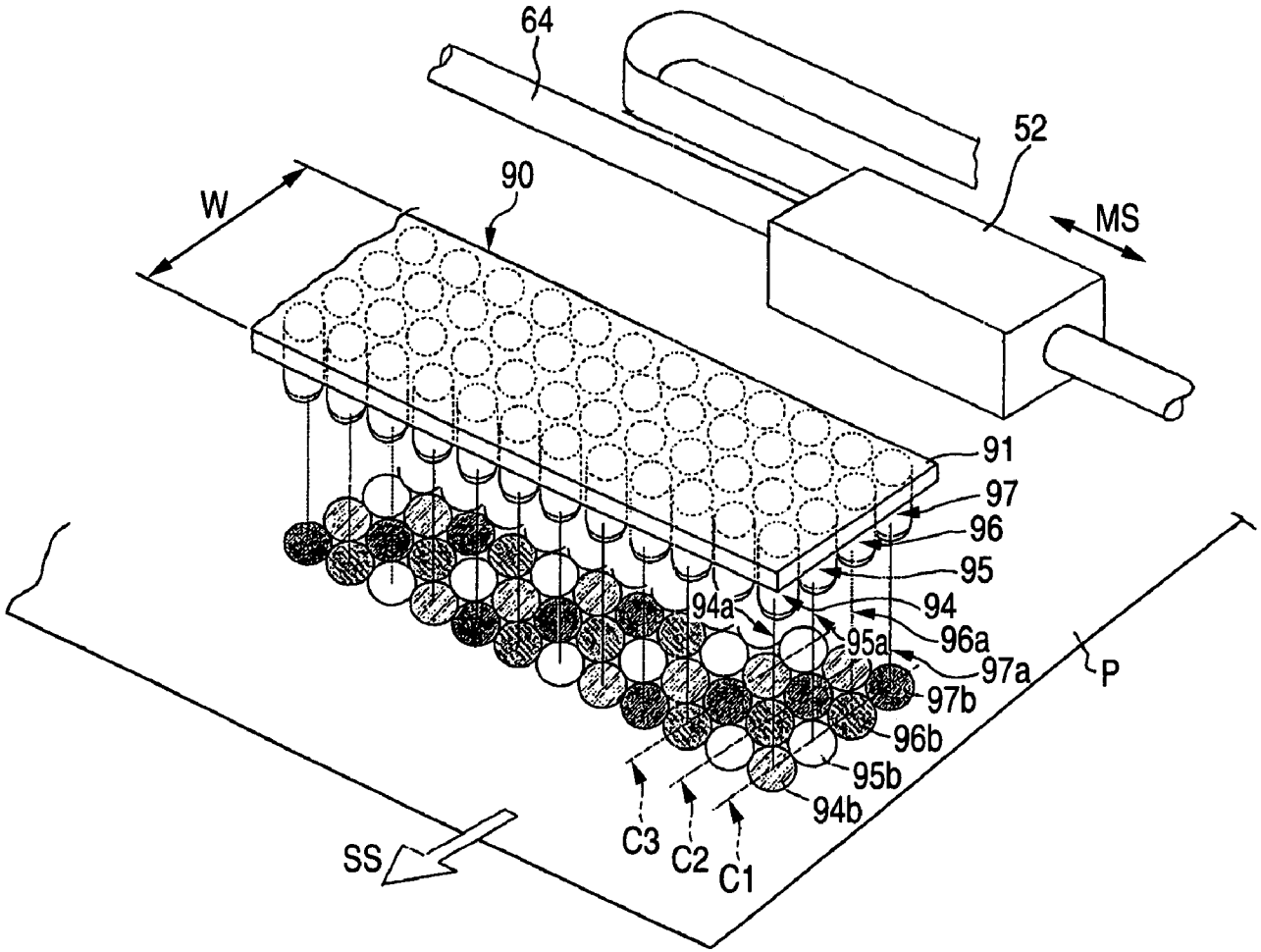
FIG. 2 is an enlarged perspective view showing the ultraviolet rays emitter illustrated in FIG. 1.

As shown in FIGS. 1 and 2, the ultraviolet rays emitter 90 includes a plurality of semiconductor light emitting elements 94, 95, 96 and 97 for emitting ultraviolet rays, a support member 91 for supporting these semiconductor light emitting elements 94, 95, 96 and 97, brackets 92 and 93 for fixing the support member 91 to the housing of the printer 20, and an ultraviolet rays emitter driving circuit 160 (see FIG. 3) for controlling the light emission and light-out of each of the semiconductor light emitting elements 94, 95, 96 and 97.

The support member 91 is a plate-shaped structural member having a predetermined width W (see FIG. 2) in the sub scanning direction SS of the print paper P in the printer 20, and furthermore, a predetermined length L (see FIG. 1) in the main scanning direction MS. The length L is set to be greater than the width of a maximum paper which can be handled in the printer 20.

The support member 91 is fixed to the housing of the printer 20 by means of the brackets 92 and 93 in a state in which an attachment surface for attaching four kinds of semiconductor light emitting elements 94, 95, 96 and 97 in a matrix is opposed to the surface of the print paper P.

Moreover, a position in which the support member 91 is to be provided is placed apart from the print head 52 by a constant distance in a forward direction (in the sub scanning direction SS).

The brackets 92 and 93 fix the ends of the support member 91 to the housing of the printer 20 with a screw or through concavo-convex fitting.

In the embodiment, as shown in FIG. 2, the support member 91 supports the semiconductor light emitting elements 94, 95, 96 and 97 mutually in a matrix with optical axes 94*a*, 95*a*, 96*a* and 97*a* aligned in almost parallel in such a manner that mutual irradiation regions 94*b*, 95*b*, 96*b* and 97*b* of the semiconductor light emitting elements 94, 95, 96 and 97 are gathered in an almost adjacent state to form a wide irradiation region.

The matrix of the semiconductor light emitting elements 94, 95, 96 and 97 according to the embodiment has an array including four rows and multiple columns in which an array provided in the main scanning direction MS indicates a "row" and an array provided in almost the sub scanning direction SS indicates a "column" (arrays provided along segments C1, C2, C3 . . . in FIG. 2).

Moreover, the four kinds of semiconductor light emitting elements 94, 95, 96 and 97 forming the matrix are ultraviolet rays emitting diodes having different wavelength ranges of ultraviolet rays to be emitted.

In the embodiment, the four kinds of semiconductor light emitting elements 94, 95, 96 and 97 having peak wavelengths of 320 nm, 365 nm, 380 nm and 420 nm are employed in consideration of the curing characteristics of the ink of the ultraviolet curing type. The semiconductor light emitting elements 96 and 97 having the peak wavelengths of 380 nm and 420 nm do not correspond to an absorption wavelength of 200 to 375 nm of titanium dioxide contained as a coloring material in a white ink and are effective for curing the white ink containing the titanium dioxide as the coloring material.

The semiconductor light emitting element 94 having the peak wavelength of 320 nm has a comparatively low wavelength range. Therefore, ultraviolet rays are absorbed more easily than ultraviolet rays having a high wavelength range, and the semiconductor light emitting element 94 is effective for curing the vicinity of the surface of an ink film adhered onto the print paper P in a short time.

It is preferable that the ultraviolet rays emitting diodes to be used for the semiconductor light emitting elements 94, 95, 96 and 97 should have a metal package provided with a condensing lens in an ultraviolet ray emitting part in order to prevent the diffusion of the ultraviolet rays to be emitted and to increase irradiation intensity per unit irradiation area. For example, an LED manufactured by Nichia Corporation, model name of NSHU590B is suitable.

In the embodiment, all of the rows and columns of the semiconductor light emitting elements supported by the support member 91 have such a structure that the four kinds of semiconductor light emitting elements 94, 95, 96 and 97 having different wavelength ranges of the ultraviolet rays to be emitted are arranged regularly in order as shown in FIG. 2.

Figure 3:
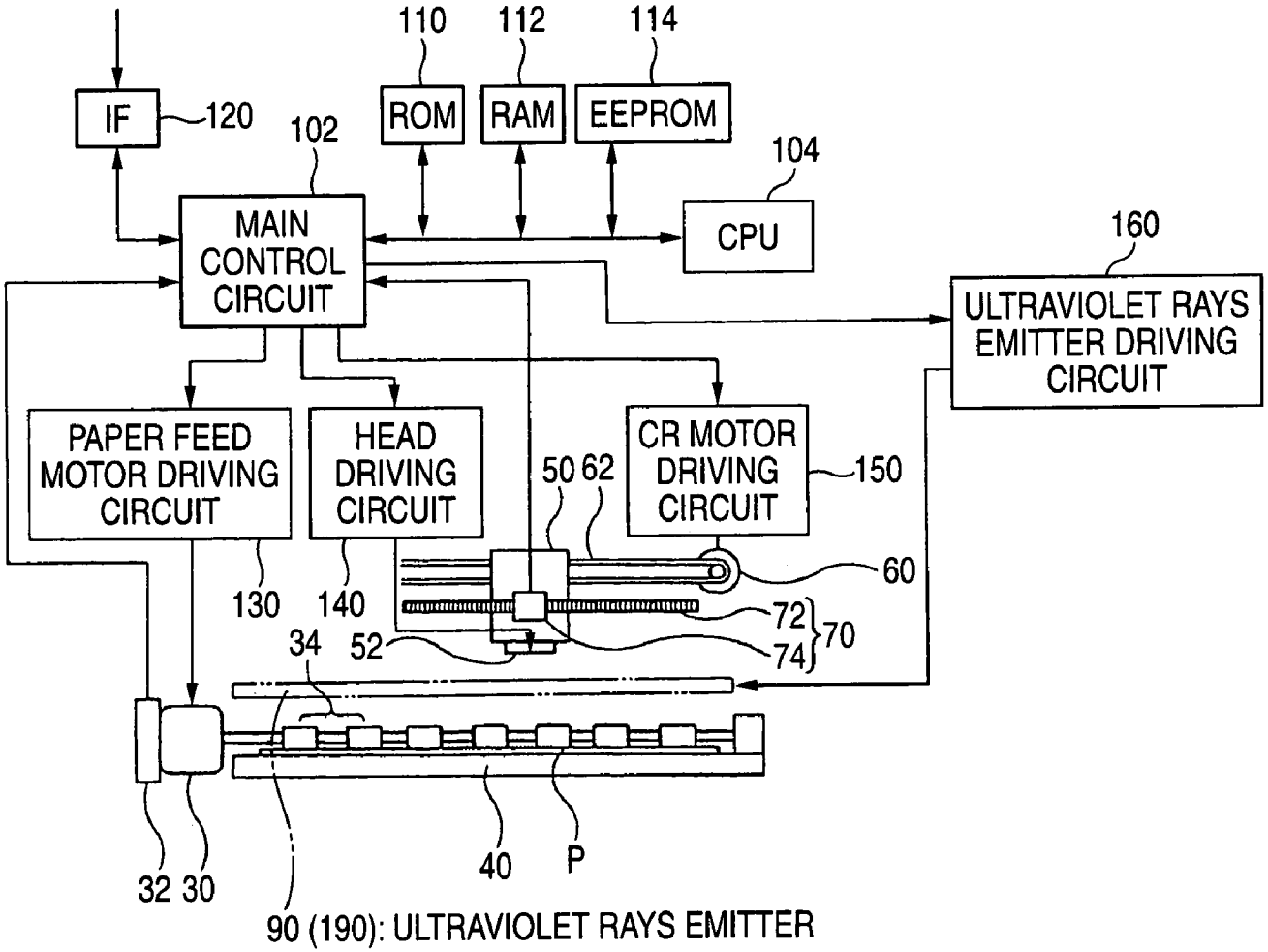
FIG. 3 is a block diagram showing an electrical structure in the ink jet printer illustrated in FIGS. 1 and 7.

Next, the electrical structure of the printer 20 will be described with reference to FIG. 3. FIG. 3 is a block diagram showing the electrical structure of the printer 20.

The printer 20 comprises a main control circuit 102, a CPU 104, and various memories connected to the main control circuit 102 and the CPU 104 through a bus (an ROM 110, an RAM 112 and an EEPROM 114).

An interface circuit 120 for communicating a signal with an external device such as a personal computer, a paper feed motor driving circuit 130, a head driving circuit 140, a CR motor driving circuit 150, and the ultraviolet rays emitter driving circuit 160 for controlling the operation of the ultraviolet rays emitter 90 are connected to the main control circuit 102.

The paper feed motor 30 is driven by the paper feed motor driving circuit 130 to rotate a paper feed roller 34, thereby moving the print paper P in the sub scanning direction. The paper feed motor 30 is provided with a rotary encoder 32, and a signal output from the rotary encoder 32 is input to the main control circuit 102.

The print head 52 having a plurality of nozzles (not shown) is provided on the bottom face of the carriage 50. Each of the nozzles is driven by the head driving circuit 140, thereby ejecting the droplets of the ink of the ultraviolet curing type which is supplied from each of the cartridges 54 and 56 toward a recording medium such as a paper, a cloth or a film.

The carriage motor 60 is driven by the CR motor driving circuit 150. The printer 20 comprises a linear encoder 70 for detecting the position and speed of the carriage 50 in the main scanning direction. The linear encoder 70 is constituted by a rectilinear coding plate 72 provided in parallel with the main scanning direction and a photo sensor 74 provided in the carriage 50. A signal output from the linear encoder 70 is input to the main control circuit 102.

The ultraviolet rays emitter driving circuit 160 controls the light emission and light-out of each of the semiconductor light emitting elements 94, 95, 96 and 97 (including 195, 196 and 197 which will be described below) which are provided based on a control signal sent from the main control circuit 102.

More specifically, when the print head 52 is driven to start printing or when the printing operation is started and the adhering surface of the ink of the ultraviolet curing type on the print paper P reaches the ultraviolet irradiation region of the ultraviolet rays emitter 90 (including 190 which will be described below), all of the semiconductor light emitting elements 94, 95, 96 and 97 (including 195, 196 and 197 which will be described below) provided on the support member 91 (including 191 which will be described below) are brought into a light emitting state and the light emitting state of each of the semiconductor light emitting elements 94, 95, 96 and 97 (including 195, 196 and 197 which will be described below) is maintained until the adhering surface of the ink of the ultraviolet curing type on the print paper P completely passes through the ultraviolet irradiation region of the ultraviolet rays emitter 90 (including 190 which will be described below).

In the case in which the absorption wavelength of an ultraviolet absorbing substance in the ink of the ultraviolet curing type is previously discriminated, the ultraviolet rays emitter driving circuit 160 can also control the light emission, for example, can selectively emit a light from only the semiconductor light emitting element having a wavelength range which does not correspond to the same absorption wavelength.

The main control circuit 102 has the function of supplying a control signal to the four driving circuits 130, 140, 150 and 160 respectively, and furthermore, the function of decoding various print commands received by the interface circuit 120 and executing a control related to the regulation of print data and monitoring of various sensors. On the other hand, the CPU 104 has various functions for assisting the main control circuit 102 and executes the control of various memories, for example.

In the ultraviolet rays emitter 90 described above, the semiconductor light emitting elements 94, 95, 96 and 97 having small wavelength regions of the emitted light and including no infrared light in the emitted light are used as light sources for emitting the ultraviolet rays. Therefore, the print paper P to be the recording medium can be prevented from being thermally damaged in the irradiation of the ultraviolet rays.

Moreover, the semiconductor light emitting elements 94, 95, 96 and 97 to be the light sources consume smaller power and have smaller sizes and weights as compared with a known ultraviolet lamp. Therefore, energy saving can be carried out and the size and weight of the device can also be reduced.

In the semiconductor light emitting elements 94, 95, 96 and 97 arranged in a matrix on the support member 91, the mutual irradiation regions 94*b*, 95*b*, 96*b* and 97*b* of the respective semiconductor light emitting elements are gathered in an almost adjacent state, thereby forming a wide irradiation region. When passing through these irradiation regions, the print paper P to be the recording medium passes through the irradiation region of a single semiconductor light emitting element four times. As compared with the case in which the ultraviolet rays are irradiated only once by the single semiconductor light emitting element, consequently, the sum of an amount of irradiation of the ultraviolet rays (irradiation intensity) is approximately four times as large. Even if the ultraviolet energy for each semiconductor light emitting element is low, it is possible to give high ultraviolet energy to the surface on the recording medium to which the ink of the ultraviolet curing type is adhered and to quickly cure the ink of the ultraviolet curing type which is adhered onto the recording medium.

In the respective rows or columns of the semiconductor light emitting elements arranged in the matrix on the support member 91, moreover, there are arranged four kinds of semiconductor light emitting elements 94, 95, 96 and 97 having different wavelength ranges for ultraviolet rays to be emitted or more. In the whole ultraviolet rays emitter 90, the ultraviolet rays are irradiated on a continuous spectrum basis having a plurality of light emission peaks with different wavelengths, and ultraviolet rays in a low wavelength region and ultraviolet rays in a high wavelength region are irradiated on the ink adhered onto the print paper P to be the recording medium, respectively.

More specifically, there are respectively irradiated ultraviolet rays in a low wavelength region which have small transmission force and high energy and can cure the surface of the adhered ink in a short time and ultraviolet rays in a high wavelength region which have great transmission force and are effective for curing the inner part of the adhered ink. Consequently, the ink adhered onto the print paper P to be the recording medium can progress the ultraviolet curing well on an inside and outside in respect of an adhering thickness so that stable curing can be obtained quickly.

Moreover, at least one of the four kinds of semiconductor light emitting elements or more which have different wavelength ranges for the ultraviolet rays to be emitted is selected to have a different wavelength range from the absorption wavelength of an ultraviolet absorbing substance in the ink of the ultraviolet curing type which is to be adhered onto the print paper P to be the recording medium. Therefore, a part of the ultraviolet rays which are irradiated can effectively contribute to cure the ink without the absorption of the ultraviolet absorbing substance and the ink adhered onto the print paper P to be the recording medium can also be cured quickly irrespective of the ultraviolet absorbing function of the ultraviolet absorbing substance in the ink.

Accordingly, the ink of the ultraviolet curing type which is adhered onto the print paper P to be the recording medium can be cured quickly irrespective of an adhering thickness thereof and the ultraviolet absorbing function of the ultraviolet absorbing substance in the ink.

Moreover, the numbers of the rows and the columns and the combination of various kinds of wavelength ranges in the provision of the semiconductor light emitting elements in the matrix by the support member 91 are not restricted to the embodiment.

Figure 4:
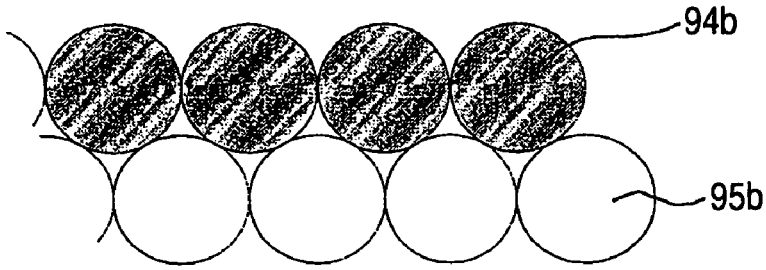
FIG. 4 is an explanatory view showing a second embodiment of the array of a semiconductor light emitting element over unit support means in the ultraviolet rays emitter according to the invention.
Figure 5:
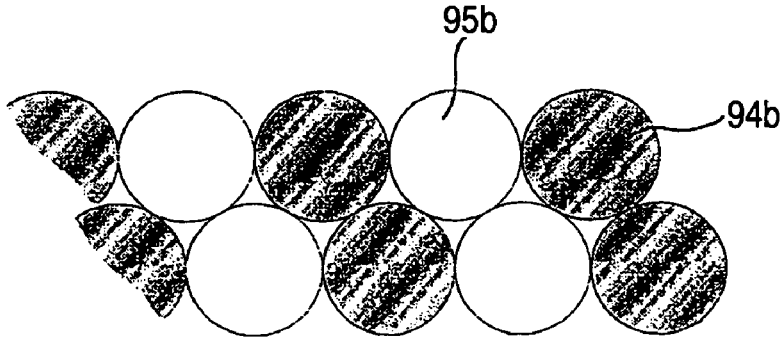
FIG. 5 is an explanatory view showing a third embodiment of the array of the semiconductor light emitting element over the support member in the ultraviolet rays emitter according to the invention.
Figure 6:
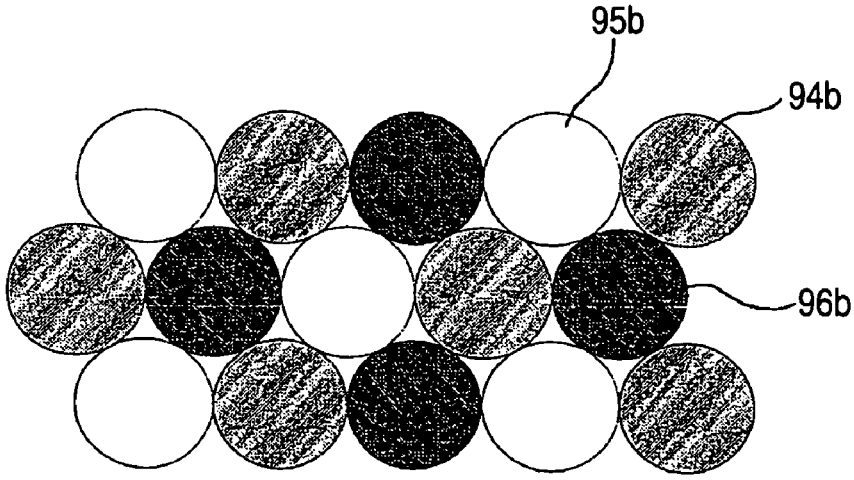
FIG. 6 is an explanatory view showing a fourth embodiment of the array of the semiconductor light emitting element over the support member in the ultraviolet rays emitter according to the invention.

For example, the matrix of the semiconductor light emitting elements to be provided in the support member 91 may have an array including two rows and multiple columns as shown in FIGS. 4 and 5, may have an array including three rows and multiple columns as shown in FIG. 6, and may have an array configuration including five rows or more which is not shown.

For the order of the array of the mutual semiconductor light emitting elements having different wavelength ranges, furthermore, it is possible to employ various arrays including an array configuration in which the semiconductor light emitting elements in the same row are united into the semiconductor light emitting elements having the same wavelength range and the wavelength range is changed for each row as shown in FIG. 4 and an array configuration in which various kinds of wavelength ranges are arranged alternately also in the same row.

By employing a configuration in which the equipment rate of the semiconductor light emitting elements having a specific wavelength range is set to be higher than that of the semiconductor light emitting elements having the other wavelength ranges depending on the ultraviolet absorbing characteristic of the ink of the ultraviolet curing type or the adhering thickness of the ink, moreover, it is also possible to exhibit a further higher curing performance.

For example, in the case in which it is a main object to cure the ink of the ultraviolet curing type which is thickly adhered onto the recording medium, there is set an equipment configuration in which the equipment number of various semiconductor light emitting elements in the support member 91 is larger for the semiconductor light emitting elements in a high wavelength region than the semiconductor light emitting elements in a low wavelength region. Consequently, the transmission of the ultraviolet rays to the inner part of the ink which is adhered is increased so that a curing failure on an inside can be reliably prevented from being generated.

Figure 7:
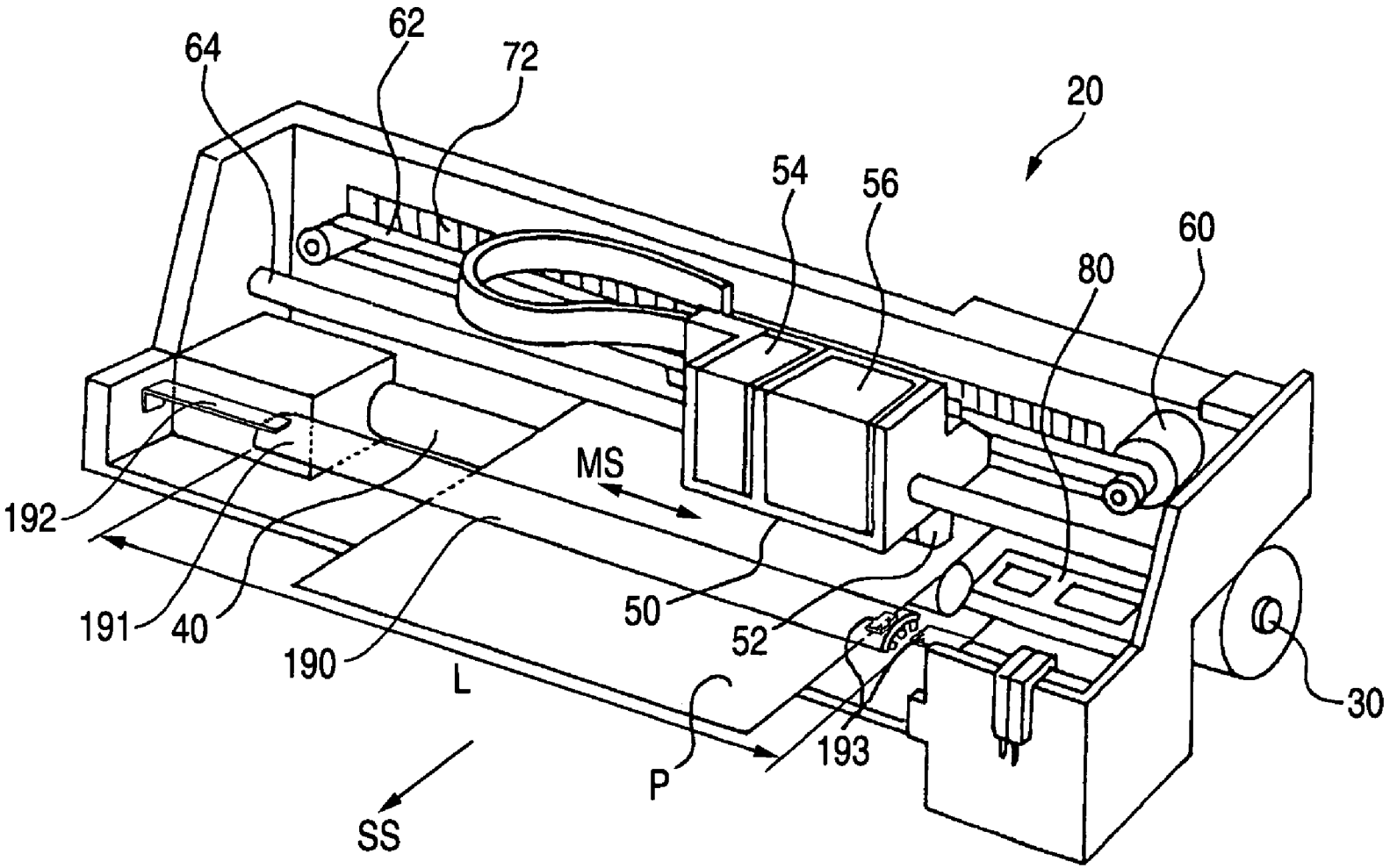
FIG. 7 is a schematic perspective view showing a main structure according to an embodiment of an ink jet printer mounting an ultraviolet rays emitter in accordance with a second example of the invention.

FIG. 7 is a schematic perspective view showing a main structure according to an embodiment of an ink jet printer 20 mounting an ultraviolet rays emitter in accordance with a second example of the invention. The second example according to the invention will be described below.

Figure 8:
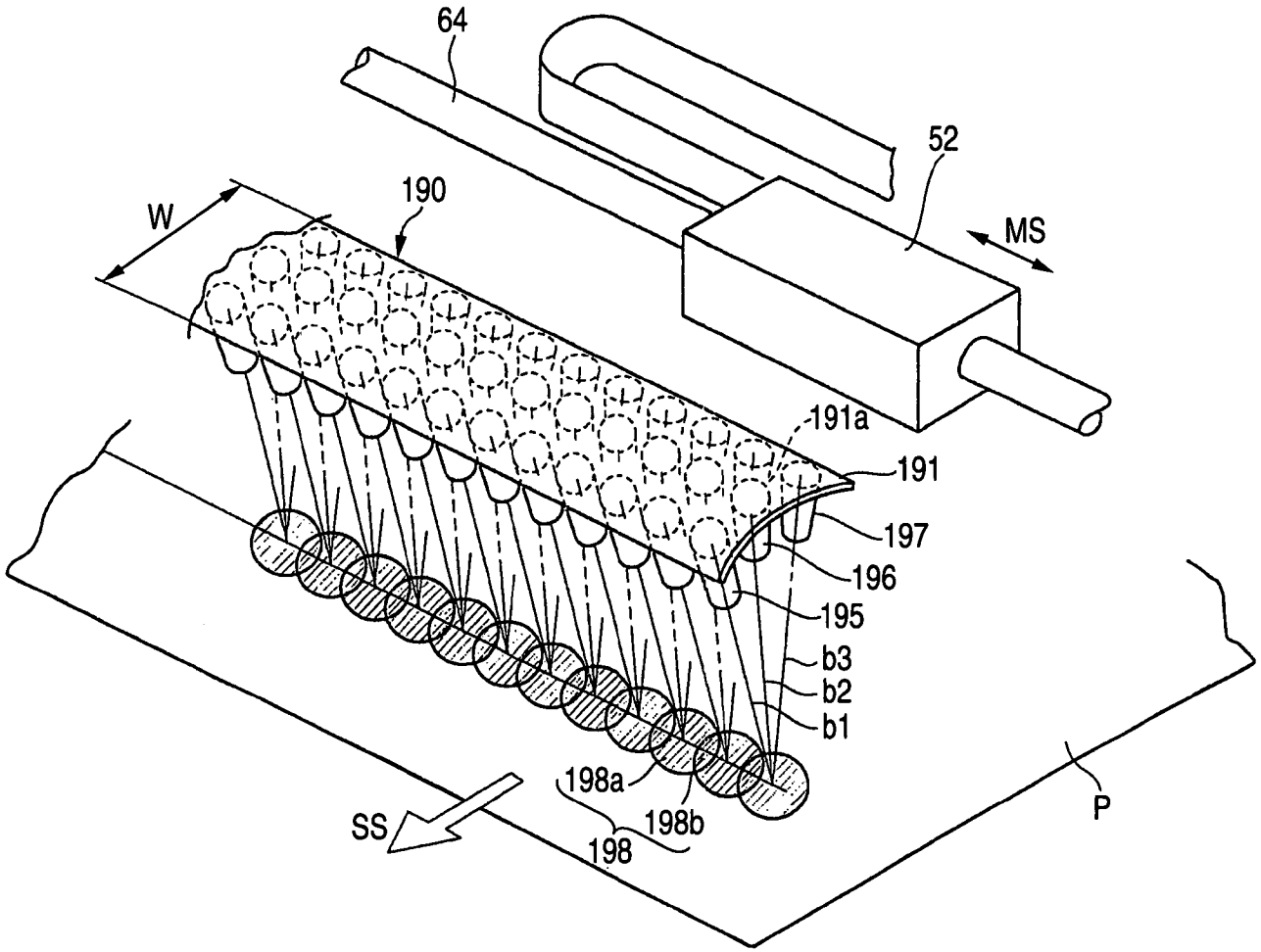
FIG. 8 is an enlarged perspective view showing the ultraviolet rays emitter illustrated in FIG. 7.

As shown in FIGS. 7 and 8, an ultraviolet rays emitter 190 includes a plurality of semiconductor light emitting elements 195, 196 and 197 for emitting ultraviolet rays, a support member 191 for supporting these semiconductor light emitting elements 195, 196 and 197, brackets 192 and 193 for fixing the support member 191 to the housing of the printer 20, and an ultraviolet rays emitter driving circuit 160 (see FIG. 3) for controlling the light emission and light-out of each of the semiconductor light emitting elements 195, 196 and 197.

The support member 191 is a plate-shaped structural member having a predetermined width W (see FIG. 8) in a sub scanning direction SS of a print paper P in the printer 20, and furthermore, a predetermined length L (see FIG. 7) in a main scanning direction MS. The length L is set to be greater than the width of a maximum paper which can be handled in the printer 20.

The support member 191 is fixed to the housing of the printer 20 by means of the brackets 192 and 193 in a state in which an attachment surface 191*a* for attaching the semiconductor light emitting elements 195, 196 and 197 is opposed to the surface of the print paper P.

Figure 9B:
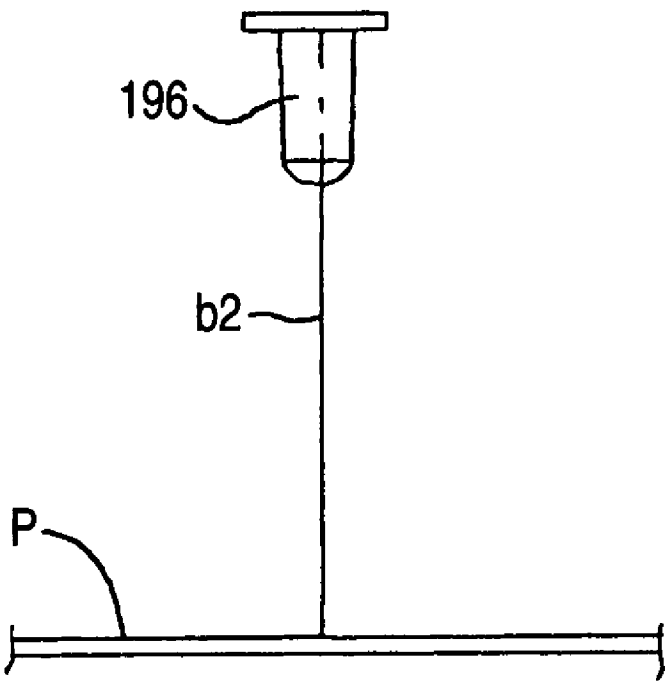
FIG. 9A is a side view showing the arrangement configuration of mutual semiconductor light emitting elements having irradiation regions overlapped with one another in the ultraviolet rays emitter illustrated in FIGS. 7 and 9B is a comparison view showing a configuration in the case in which ultraviolet rays is irradiated by a single semiconductor light emitting element.
Figure 9A:
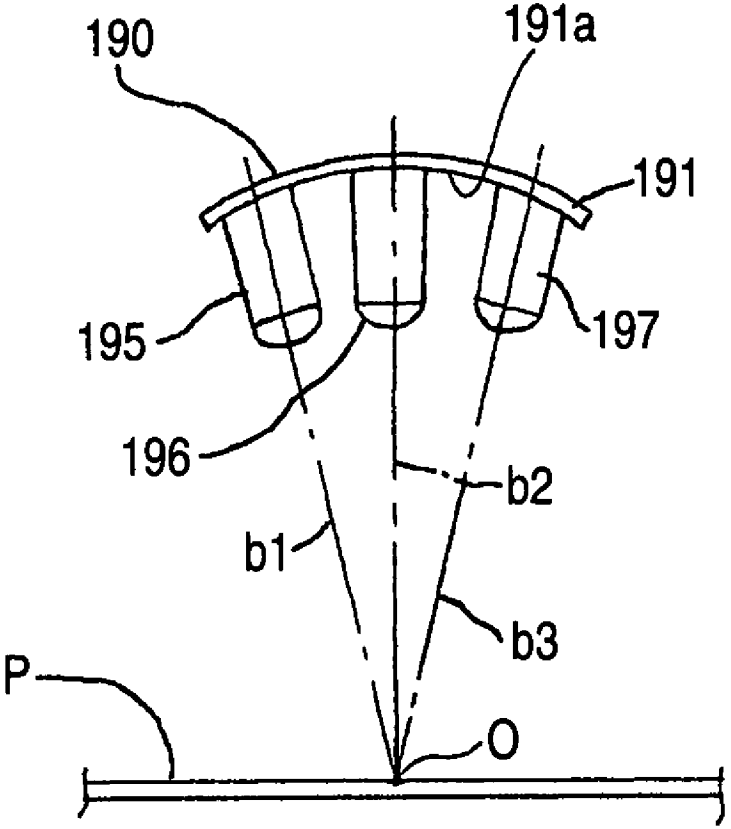

In the embodiment, as shown in FIG. 9A, the attachment surface 191*a* is formed to be an arcuate surface which has a center O of curvature in the vicinity of the irradiation region of ultraviolet rays on the print paper P and is curved in the direction of delivery of the print paper P (that is, the sub scanning direction SS).

Moreover, a position in which the support member 191 is to be provided is placed apart from a print head 52 by a constant distance in a forward direction (in the sub scanning direction SS).

The brackets 192 and 193 fix the ends of the support member 191 to the housing of the printer 20 with a screw or through concavo-convex fitting.

In the embodiment, the semiconductor light emitting elements 195, 196 and 197 are ultraviolet rays emitting diodes having the same wavelength range of ultraviolet rays to be emitted.

It is preferable that the ultraviolet rays emitting diodes to be used for these semiconductor light emitting elements 195, 196 and 197 should have a metal package provided with a condensing lens in an ultraviolet ray emitting part in order to prevent the diffusion of the ultraviolet rays to be emitted. For example, an LED manufactured by Nichia Corporation, model name of NSHU590B is suitable.

For the wavelength regions of the ultraviolet rays to be emitted from the semiconductor light emitting elements 195, 196 and 197, it is possible to select wavelength regions having peak wavelengths of 365 nm, 375 nm and 400 nm in consideration of the curing characteristic of the ink of the ultraviolet curing type. In the selection of the semiconductor light emitting element, it is preferable to select the semiconductor light emitting element in which the peak wavelength of the ultraviolet rays output from the semiconductor unit is not coincident with the absorption wavelength of the ultraviolet absorbing substance in the ink of the ultraviolet curing type.

As shown in FIG. 8, the semiconductor light emitting elements 195 are arranged at a constant interval in the main scanning direction MS on this side of the attachment surface 191*a*, thereby forming a unit line. Moreover, the semiconductor light emitting elements 197 are arranged at a constant interval in the main scanning direction MS on the inner side of the attachment surface 191*a*, thereby forming a unit line. The semiconductor light emitting elements 196 are arranged at a constant interval in the main scanning direction MS between the unit line of the semiconductor light emitting elements 195 and that of the semiconductor light emitting elements 197, thereby forming a unit line.

In the semiconductor light emitting elements 195, 196 and 197 in the unit lines, equipment positions are aligned in the main scanning direction MS. Accordingly, the semiconductor light emitting elements 195, the semiconductor light emitting elements 196 and the semiconductor light emitting elements 197 are arranged in a line in the sub scanning direction SS.

As shown in FIG. 9A, similarly, the semiconductor light emitting elements 195, 196 and 197 are attached to the support member 191 in such a manner that respective optical axes b1, b2 and b3 are orthogonal to the attachment surface 191*a*.

Accordingly, the three semiconductor light emitting elements 195, 196 and 197 arranged in the sub scanning direction SS on the attachment surface 191a are provided in a positional relationship in which the respective optical axes b1, b2 and b3 are inclined mutually, and the respective optical axes b1, b2 and b3 cross one another at the center O of curvature of the attachment surface 191*a*. Therefore, the irradiation regions on the print paper P are overlapped with one another.

The irradiation regions of the three semiconductor light emitting elements 195, 196 and 197 arranged in the sub scanning direction SS over the attachment surface 191*a* have the same size as that of the irradiation region in one of the semiconductor light emitting elements and take a circular shape as shown in FIG. 8 in the embodiment.

In the main scanning direction MS, the mutual circular irradiation regions which are adjacent to one another are arranged with a partial overlap. As shown in FIG. 8, therefore, an irradiation region 198 formed in a line in the main scanning direction MS has such a configuration that an irradiation region 198*a* having basic irradiation intensity which is formed by the overlap of the irradiation regions of the semiconductor light emitting elements 195, 196 and 197 and an irradiation region 198*b* having high irradiation intensity which is formed with the overlap of the irradiation regions 198*a* are arranged alternately.

In the ultraviolet rays emitter 190 described above, the semiconductor light emitting elements 195, 196 and 197 having small wavelength regions for emitted lights and including no infrared light in the emitted lights are used as light sources for emitting ultraviolet rays. Therefore, it is possible to prevent the print paper P to be the recording medium from being thermally damaged in the irradiation of the ultraviolet rays.

Moreover, the semiconductor light emitting elements 195, 196 and 197 to be the light sources consume smaller power and have smaller sizes and weights as compared with a known ultraviolet lamp. Therefore, energy saving can be carried out and the size and weight of the device can also be reduced.

The semiconductor light emitting elements 195, 196 and 197 arranged in a line in the sub scanning direction SS have a common wavelength region for the ultraviolet rays to be emitted and the irradiation regions of the emitted ultraviolet rays are overlapped with one another over the print paper P. As compared with the case in which the ultraviolet rays are to be irradiated by the single semiconductor light emitting element 196 as shown in FIG. 3B, therefore, the amount of irradiation of the ultraviolet rays per unit area (the irradiation intensity) is plural times as large. Even if ultraviolet energy for one of the semiconductor light emitting elements 195, 196 and 197 is low, high ultraviolet energy can be applied to the adhering surface of the ink of the ultraviolet curing type over the print paper P. Thus, it is possible to quickly cure the ink of the ultraviolet curing type which is adhered onto the print paper P.

In the ultraviolet rays emitter 190 according to the embodiment, moreover, the attachment surface 191*a* of the support member 191 which attaches the semiconductor light emitting elements 195, 196 and 197 has an arcuate surface. If the semiconductor light emitting elements 195, 196 and 197 are mutually attached perpendicularly to the attachment surface 191*a* on the same circumference in the sub scanning direction SS, therefore, the optical axes b1, b2 and b3 of the semiconductor light emitting elements 195, 196 and 197 are turned toward the center O of curvature of the arcuate surface so that the overlapping state of the irradiation regions can easily be obtained.

The number of the semiconductor light emitting elements to be disposed so as to cause the irradiation regions on the print paper P to be overlapped with one another is not restricted to that in the embodiment.

It is also possible to make a proposal for employing a structure in which the irradiation regions of two ultraviolet rays emitting diodes arranged in the sub scanning direction SS are overlapped with one another or the irradiation regions of the four ultraviolet rays emitting diodes arranged in the sub scanning direction SS are overlapped with one another corresponding to the emission intensity of ultraviolet rays in an ultraviolet rays emitting diode to be used or the characteristic of the ink of the ultraviolet curing type.

In the embodiment, moreover, the semiconductor light emitting elements 95, 96 and 97 having the irradiation regions being overlapped over the print paper P are arranged to have the same wavelength range.

However, it is also possible to make a proposal for employing a structure in which the wavelength ranges of the ultraviolet rays to be emitted which are different from each other are used in the semiconductor light emitting elements 95, 96 and 97 having the irradiation regions overlapping over the print paper P.

In that case, it is possible to irradiate ultraviolet rays in a wider wavelength region having a plurality of light emission peaks as compared with the case in which ultraviolet rays are irradiated by a single semiconductor light emitting element. Even if the ultraviolet rays in a part of the wavelength regions are absorbed by the ultraviolet absorbing function of the ultraviolet absorbing substance in the ink of the ultraviolet curing type which is adhered onto the recording medium, therefore, ultraviolet rays in the other wavelength regions can contribute to the curing of the ink without the absorption of the ultraviolet absorbing substance. Consequently, it is possible to quickly cure the ink adhered onto the recording medium irrespective of the ultraviolet absorbing function of the ultraviolet absorbing substance in the ink.

In the case in which the wavelength ranges of the ultraviolet rays to be emitted which are different from one another are used in the semiconductor light emitting elements 95, 96 and 97 having the irradiation regions being overlapped over the print paper P, moreover, it is possible to omit a wasteful light emission and to thus save energy by the selection of the semiconductor light emitting element for emitting a light corresponding to the composition of the component in the ink of the ultraviolet curing type which is to be used.

For example, in the case in which an ultraviolet LED having a peak wavelength of 365 nm in ultraviolet rays to be output is used for the semiconductor light emitting element 95, an ultraviolet LED having a peak wavelength of 375 nm in ultraviolet rays to be output is used for the semiconductor light emitting element 96, and an ultraviolet LED having a peak wavelength of 400 nm in ultraviolet rays to be output is used for the semiconductor light emitting element 97, each of the semiconductor light emitting elements is ON/OFF controlled by the ultraviolet rays emitter driving circuit 160 in a unit of a unit line having the same wavelength to confirm a progress in the curing of the ink of the ultraviolet curing type corresponding to the composition of the component in the ink of the ultraviolet curing type.

In the case in which the ink of the ultraviolet curing type is a transparent ink, the unit line of the semiconductor light emitting elements 95 having the peak wavelength of 365 nm is caused to emit a light so that the same ink can be cured without troubles.

On the other hand, in the case in which the ink of the ultraviolet curing type is a white water-based ink, the absorption wavelength of titanium dioxide contained in the same ink is 200 to 375 nm. By causing the unit line of the semiconductor light emitting elements 97 having the peak wavelength of 400 nm to emit a light, therefore, it is possible to cure the ink without troubles.

In the first example and the second example, in the printer 20 equipped with the ultraviolet rays emitter 90 (190) in the vicinity of the print head 52, it is possible to shorten a time required for curing the ink, thereby enhancing a print processing speed.

Moreover, the semiconductor light emitting element to be used as a light source for emitting ultraviolet rays is not restricted to the ultraviolet rays emitting diodes described in the first example and the second example. It is also possible to utilize a unit for emitting a laser beam, for example, a laser diode.

An apparatus equipped with the ultraviolet rays emitter according to the invention is not restricted to the ink jet printer. The ultraviolet rays emitter can be mounted on various apparatuses for adhering the ink of the ultraviolet curing type.

Moreover, it is possible to propose various materials of the recording medium on which the ultraviolet rays is to be irradiated by the ultraviolet rays emitter according to the invention, for example, a paper, a film, a cloth and a metallic thin plate.

Furthermore, the ink of the ultraviolet curing type which can be cured by the ultraviolet rays emitter according to the invention is not particularly restricted but it is possible to use well-known and official inks described in JP-A-3-216379, JP-A-5-186725, JP-B-5-54667, JP-A-6-200204, JP-A-7-224241, JP-A-8-48922, JP-A-8-218016, JP-A-10-7956, JP-A-10-250052, JP-A-10-324836, JP-A-2000-44857, JP-A-2000-119574, JP-A-2000-158793, JP-A-2000-186242, JP-A-2000-186243, JP-A-2000-336295, JP-W-2000-504778, JP-W-2001-512777, JP-A-2001-220526, JP-A-2002-80767, JP-A-2003-191593, JP-A-2003-191594, JP-A-2003-313476, JP-A-2004-27154, and U.S. Pat. No. 5,623,001.

What is claimed is:

1. An ultraviolet rays emitter, emitting ultraviolet rays onto an ink of an ultraviolet curing type, which is ejected onto a recording medium by recording head, comprising:

a support member; and a plurality of light emitting elements attached to the support member and adapted to emit ultraviolet rays, wherein the light emitting elements are arranged in rows and columns with optical axes thereof aligned in almost parallel to one another so that irradiation regions of the ultraviolet rays emitted by the light emitting elements are gathered in a state being almost adjacent to one another so as to form a large irradiation region, and at least two of the emitting elements emitting the ultraviolet rays having different wavelength ranges are arranged in one of the rows, and at least two of the emitting elements emitting the ultraviolet rays having different wavelength ranges are arranged in one of the columns.

2. The ultraviolet rays emitter according to claim 1, wherein the light emitting element includes an ultraviolet rays emitting diode.

3. The ultraviolet rays emitter according to claim 1, wherein the light emitting element includes a laser diode.

4. The ultraviolet rays emitter according to claim 1, wherein the support member is disposed at the vicinity of the recording head.

5. A recording device for recording on a recording medium comprising:

a recording head;

a feeder adapted to feed the recording medium in a first direction; and an ultraviolet rays emitter having a plurality of ultraviolet rays emitting elements adapted to emit ultraviolet rays at least in part overlapping with one another on the recording medium, wherein a first area on which the ultraviolet rays emitted by the light emitting elements arranged in the first direction are overlapped with one another is greater than a second area on which the ultraviolet rays emitted by the light emitting elements arranged in a second direction perpendicular to the first direction are overlapped with one another.

6. The recording device according to claim 5, wherein the ultraviolet rays emitting elements are adapted to emit ultraviolet rays in parallel to one another.

7. The recording device according to claim 5, wherein at least two of the ultraviolet rays emitting elements emit ultraviolet rays having different wavelength ranges.

8. The recording device according to claim 5, wherein at least two of the ultraviolet rays emitting elements are adjacent to one another.

9. The ultraviolet rays emitter according to claim 1, wherein the rows in which the light emitting elements are arranged extend in a sub scanning direction, and the columns in which the light emitting elements are arranged extend in a main scanning direction.

* * * * *